United States Patent [19]

Takahashi et al.

[11] Patent Number: 4,741,636

[45] Date of Patent: May 3, 1988

[54] DOT DRIVE CIRCUIT OF WIRE DOT TYPE PRINTER

[75] Inventors: Yoshinori Takahashi; Kohtaroh Yoshimura; Takeo Fujii, all of Tokyo, Japan

[73] Assignee: OKI Electric Industry Co., Ltd., Tokyo, Japan

[21] Appl. No.: 927,711

[22] Filed: Nov. 7, 1986

[30] Foreign Application Priority Data

Nov. 15, 1985 [JP] Japan ..... 60-255111

[51] Int. Cl.[4] ..... B41J 9/38

[52] U.S. Cl. ..... 400/124; 400/157.3; 400/166; 101/93.05

[58] Field of Search ..... 400/124, 157.2, 157.3, 400/166, 167; 361/154; 101/93.02, 93.03, 93.05

[56] References Cited

FOREIGN PATENT DOCUMENTS 7065 1/1984 Japan ..... 400/157.3

*Primary Examiner*—Paul T. Sewell

*Attorney, Agent, or Firm*—Wenderoth, Lind & Ponack

[57] ABSTRACT

A dot drive circuit for a wire dot type printer including dot pins of a print head different in gaps with respect to a platen sets dot drive time intervals for each dot pin or for each dot pin group in accordance with the size of the gap.

4 Claims, 6 Drawing Sheets

CIRCUIT BLOCK DIAGRAM ILLUSTRATING A FIRST EMBODIMENT OF A DOT DRIVE CIRCUIT OF THE PRESENT INVENTION

CIRCUIT BLOCK DIAGRAM ILLUSTRATING A FIRST EMBODIMENT OF A DOT DRIVE CIRCUIT OF THE PRESENT INVENTION

ILLUSTRATION SHOWING A DISTANCE RELATION BETWEEN A PRINTING PAPER AND A DOT PIN

TIMING CHART ILLUSTRATING FIG. 1

CIRCUIT BLOCK DIAGRAM ILLUSTRATING A SECOND EMBODIMENT OF A DOT DRIVE CIRCUIT OF THE PRESENT INVENTION

CIRCUIT BLOCK DIAGRAM ILLUSTRATING A PRIOR DOT DRIVE CIRCUIT

TIMING CHART ILLUSTRATING FIG. 5

DOT DRIVE CIRCUIT OF WIRE DOT TYPE PRINTER

BACKGROUND OF THE INVENTION

1. Field of the Invention

The present invention relates to a wire dot type printer having dot pins of a print head being different in gaps thereof with respect to a platen from each other, and more particularly to a dot drive circuit for controlling the drive time interval of the dot pin.

2. Description of the prior Art

FIG. 2 is an illustration which shows a distance relation between a printing paper and a dot pin. As shown in the figure, a wire dot type print head 1 (hereinafter simply referred to as a print head) is diposed in a confronting relation with a platen 2. Dot pins 3 of the print head 1 respectively have a different gap to the platen 2, and they provide a maximum gap L between the tip ends of the uppermost end and the lowermost end of the dot pins 3 and a printing paper 4 placed on the platen 2. The print head 1 employed here is of a 9-pin head.

Conventionally, the dot pin 3 of the print head 1 is driven by a drive circuit shown in FIG. 5. The drive circuit of FIG. 5 is a prior example. As shown in the figure, designated at 5 is a microprocessor, etc., which issues a timing signal A for driving the dot pin and selection signals $B_1$, through $B_9$ each for selecting the dot pin in concern driven in certain drive timing. Designated at 6 is a monostable multivibrator (hereinafter referred to as monostable), which receives the drive timing signal A and thereby generates a drive pulse C. Designated at $7_a$ through $7_i$ are respectively gate circuits, each of which switches on transistors $8_a$ through $8_i$ respectively corresponding to the selection signals $B_1$ through $B_9$ when the monostable 6 issues the drive pulse C, for conducting a current through magnets $9_a$ through $9_i$ for printing.

FIG. 6 is a timing chart illustrating the dot drive circuit of FIG. 5. Here, the timing chart is for a signal corresponding to an odd-numbered dot pin 3 for brevity of the description. As shown in FIG. 6, when the microprocessor 5 shown in FIG. 3 issues selection signals $B_1$, $B_3$, $B_5$, $B_7$, and $B_9$ for example and furthermore issues the drive timing signal A, the monostable multivibrator 6 issues the drive pulse C during a preset dot drive time interval T. With this output signal, the transistors $8_a$, $8_c$, $8_e$, $8_g$, $8_i$ gets an on-state during the time interval T to operate the magnets $9_a$, $9_c$, $9_e$, $9_g$, and $9_i$ for printing.

Thereupon, the dot drive time interval T is set to apply sufficient impact force to the dot pin 3 even if the moving distance of the dot pin 3 is the maximum gap L of FIG. 2.

However, such a prior technique has a gap between a central dot pin and the platen made narrower as compared with the maximum gap L, so that the central impact force becomes excessive and hence results in uneven printing density as well as stains due to the dot pin being rebounded.

SUMMARY OF THE INVENTION

In view of the drawbacks of the prior technique, it is an object of the present invention to provide a wire dot printer excellent in printing quality by making uniform the impact force of each dot pin.

To achieve the above object, a dot drive circuit of a wire dot type printer having dot pins of a print head being different in gaps thereof to the platen with each other includes means for setting dot drive time interval of each dot pin for each dot pin or for each group of dot pins in response to the magnitude of the gap.

Then the effect of the present invention having the features described above will be described with reference to FIG. 1. First, when the microprocessor 5 issues the dot drive timing signal A to the means for setting a dot drive time interval, i.e., to the monostable vibrators 10*a* through 10*i*, the monostable vibrators $10_a$ through $10_i$, respectively issue drive pulses $C_1$ through $C_9$ to the gate circuits $7_a$ through $7_i$.

Moreover, when the microprocessor 5 issues arbitrary selection signals $B_i$ through $B_9$ to the gate circuits $7_a$ through $7_i$, power is supplied to the magnets $9_a$ through $9_i$ corresponding to the selection signals $B_1$ through $B_9$ for printing only during the time when the drive pulses $C_1$ through $C_9$ have been issued.

Hereby, the dot drive time interval is set in response to each gap between the platen and the dot pin for assuring uniform impact force of the dot pins.

The above and other objects, features and advantages of the present invention will become more apparent from the following description when taken in conjunction with the accompanying drawings in which preferred embodiments of the present invention are shown by way of illustrative examples.

DESCRIPTION OF THE PREFERRED EMBODIMENT

In succession, a first embodiment of a dot drive circuit of the present invention will be described with reference to FIGS. 1 and 5. The same number shall be applied to the same parts of the prior art describesd above.

Figure 1:
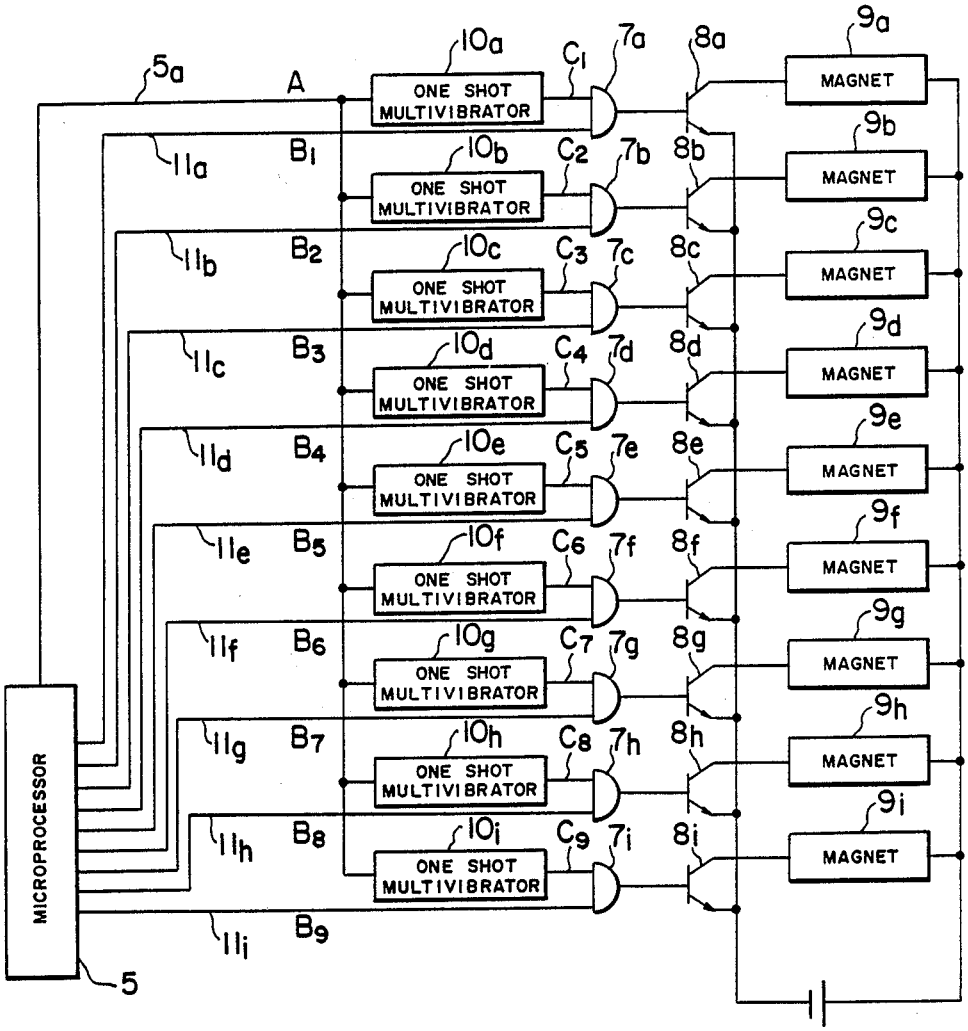
FIG. 1 is a block diagram illustrating a first embodiment of a dot drive circuit according to the present invention.
Figure 2:
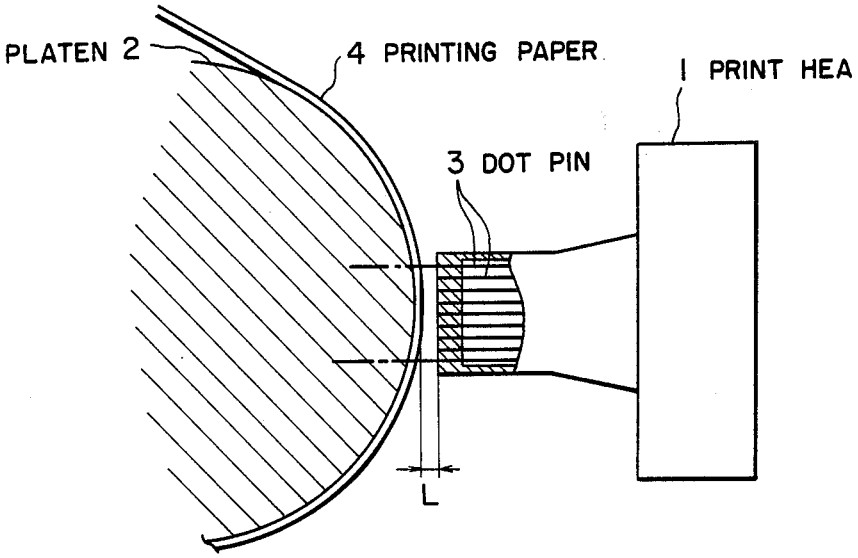
FIG. 2 is a view illustrating a distance relation between a printing paper and a dot pin of the present invention.
Figure 3:
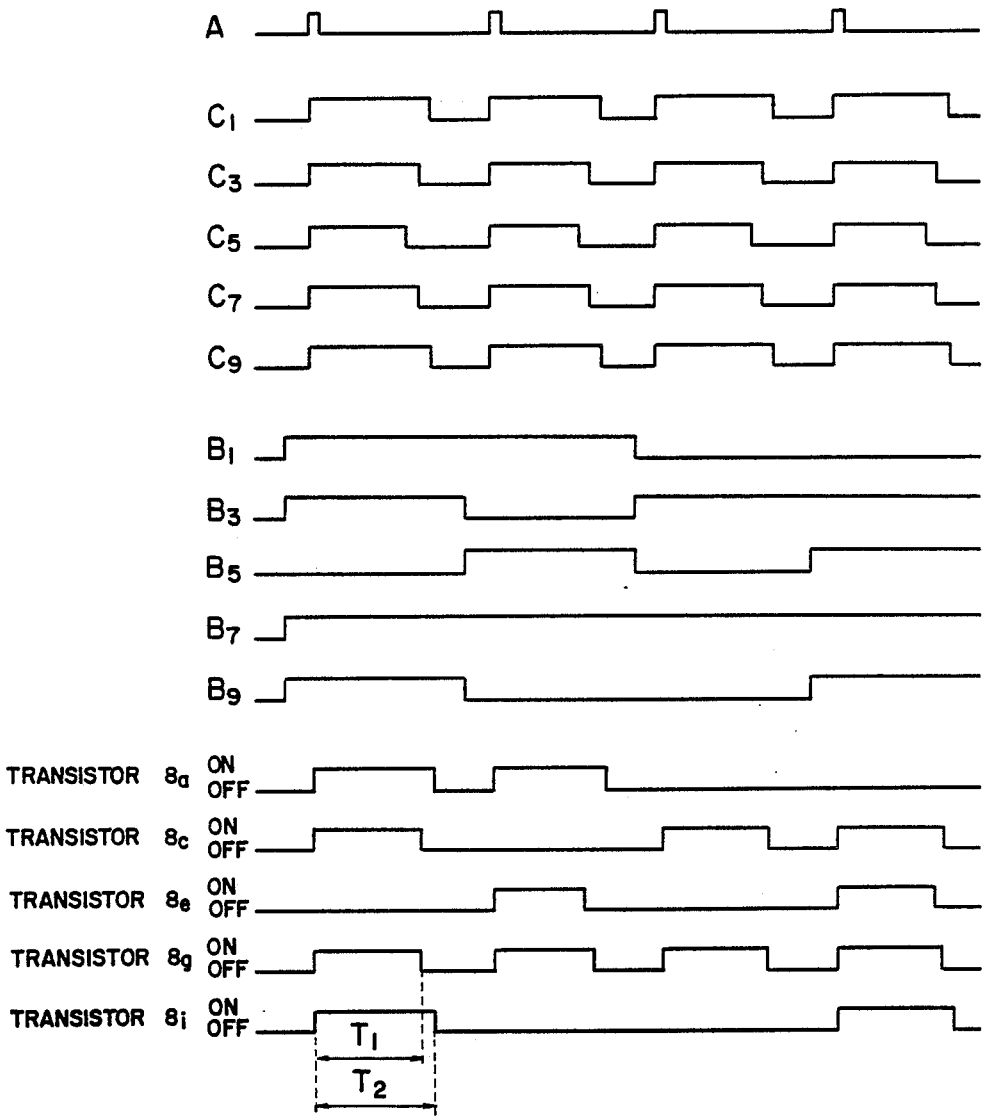
FIG. 3 is a timing chart illustrating FIG. 1.

FIG. 1 is a circuit block diagram illustrating a first embodiment of a dot drive circuit in a wire dot type printer according to the present invention, and FIG. 3 is a timing chart illustrating the dot drive circuit of FIG. 1. Here, the dot drive circuit of FIG. 1 will be described as being applicable to the print head 1 of 9 dots shown in FIG. 2. In addition, FIG. 3 shows for brevity a timing chart of a signal corresponding to an odd-numbered dot pin 3.

As shown in FIG. 1, a microprocessor 5, etc., are connected with respective monostable multivibrators $10_a$ through $10_i$ via a dot drive timing signal line $5_a$, while they are respectively connected with input terminals of one sides of gate circuits $7_a$ through $7_i$ via selection signal lines $11_a$ through $11_i$. Input terminals of the other sides of the gate circuits $7_a$ through $7_i$ are respectively connected with the monostable multivibrators $10_a$ through $10_i$. In addition, output terminals of the gate circuits $7_a$ through $7_i$ are respectively connected with bases of transistors $8_a$ through $8_i$. Emitters of these transistors $8_a$ through $8_i$ are connected with each other, while collectors thereof are respectively connected with magnets 9a through 9i. These magnetts $9_a$ through $9_i$ are disposed in order to correspond to the dot pins 3 from the upper ends thereof shown in FIG. 2 for driving dot pins 3.

Hereupon, respective drive time pulses $C_1$, through $C_9$ issued from the monostable multivbibrators $10_a$ through $10_i$ are respectively set in response to the size of each gap between the platen 2 of FIG. 2 and the dot pin 3. Namely, dot drive time intervals $T_1$ through $T_5$ are respectively set in response to the sizes of the respective gaps wherein the dot drive time interval $T_5$ for a central dot point 3 is made shortest and the other time intervals are made longer as the upper and lower end dot pins 3 are approached. Hereby, impact forces of the respective pins 3 are made uniform.

Subsequently, operation of the arrangement described above will be described. First, when the microprocessor 5, etc., issue a dot drive timing signal A to the respective monostable multivibrators $10_a$ through $10_i$, these monostable multivibrators $10_a$ through $10_i$ respectively issue drive pulses $C_1$ through $C_9$ to the gate circuits $7_a$ through $7_i$.

Figure 5:
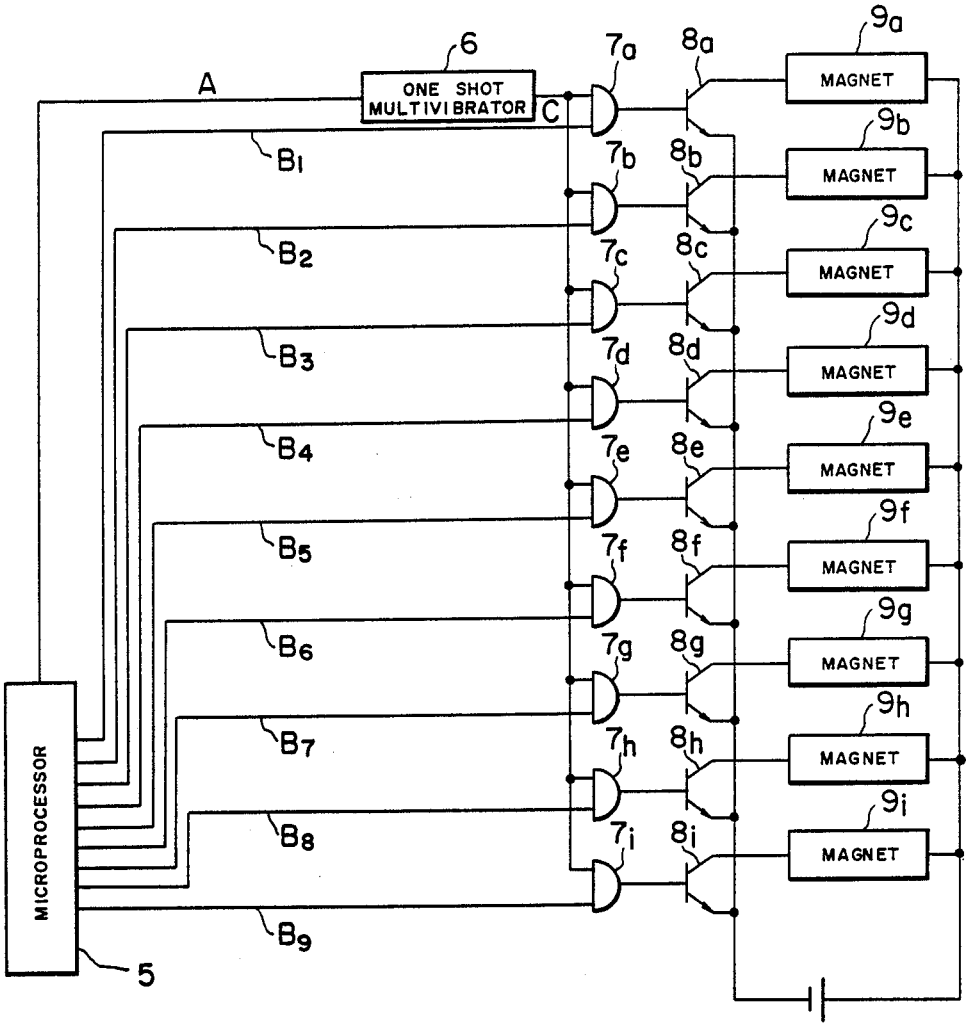
FIG. 5 is a circuit block diagram illustrating a prior dot drive circuit.
Figure 6:
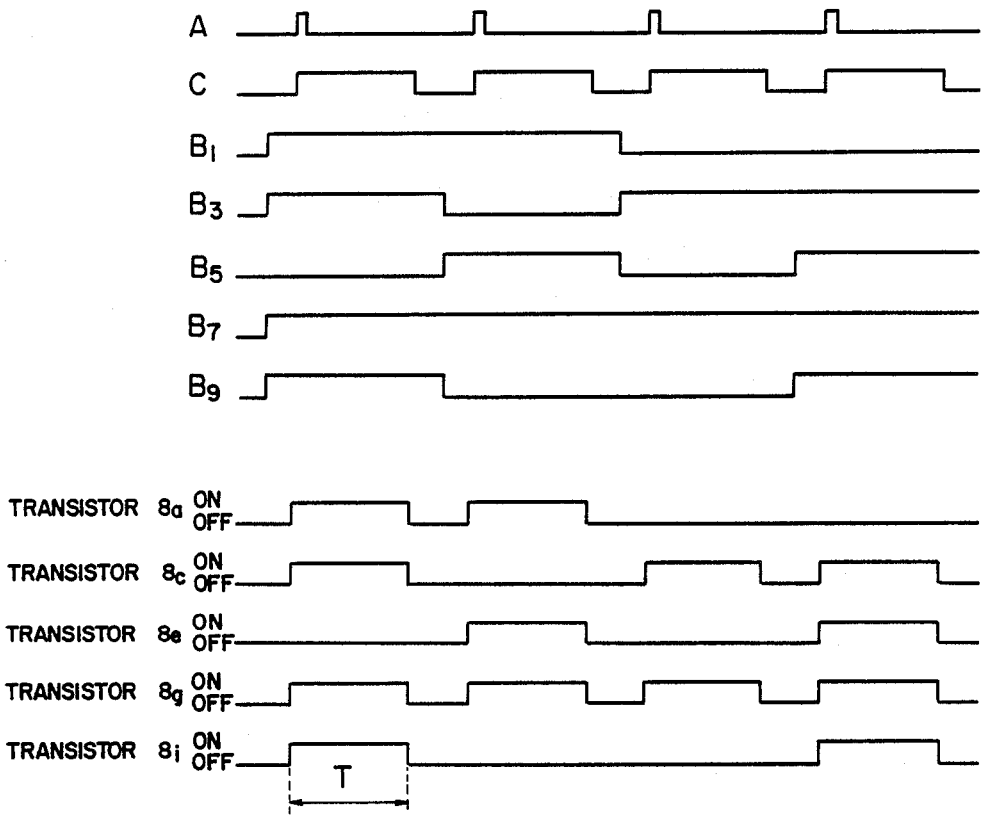
FIG. 6 is a timing chart illustrating FIG. 5.

In succession, when the microprocessor 5 issues selection signals $B_1$, $B_3$, $B_5$, $B_7$, and $B_9$ shown in FIG. 5 for example to the gate circuits $7_a$, $7_c$, $7_e$, $7_g$, and $7_i$, these gates $7_a$, $7_c$, $7_e$, 7g, and $7_i$ operate transistors $8_a$, $8_c$, $8_e$, $8_g$, and $8_i$ only when the drive pulses $C_1$, $C_3$, $C_5$, $C_7$, and $C_9$ have been issued, whereby they conduct a current through the magnets $9_a$, $9_c$, $9_e$, $9_g$, and $9_i$ for printing. Thereupon, since the dot drive time intervals $T_1$, $T_2$ have been setin response to the respective gaps between the platen 2 and thedot pins 3, the respective dot pins 3 provide uniform impact force.

In the following, a second embodiment of the dot drive circuit of the present invention will be described with reference to FIG. 4. Here, the same numbers shall be applied to the same portions as those of the prior art.

Figure 4:
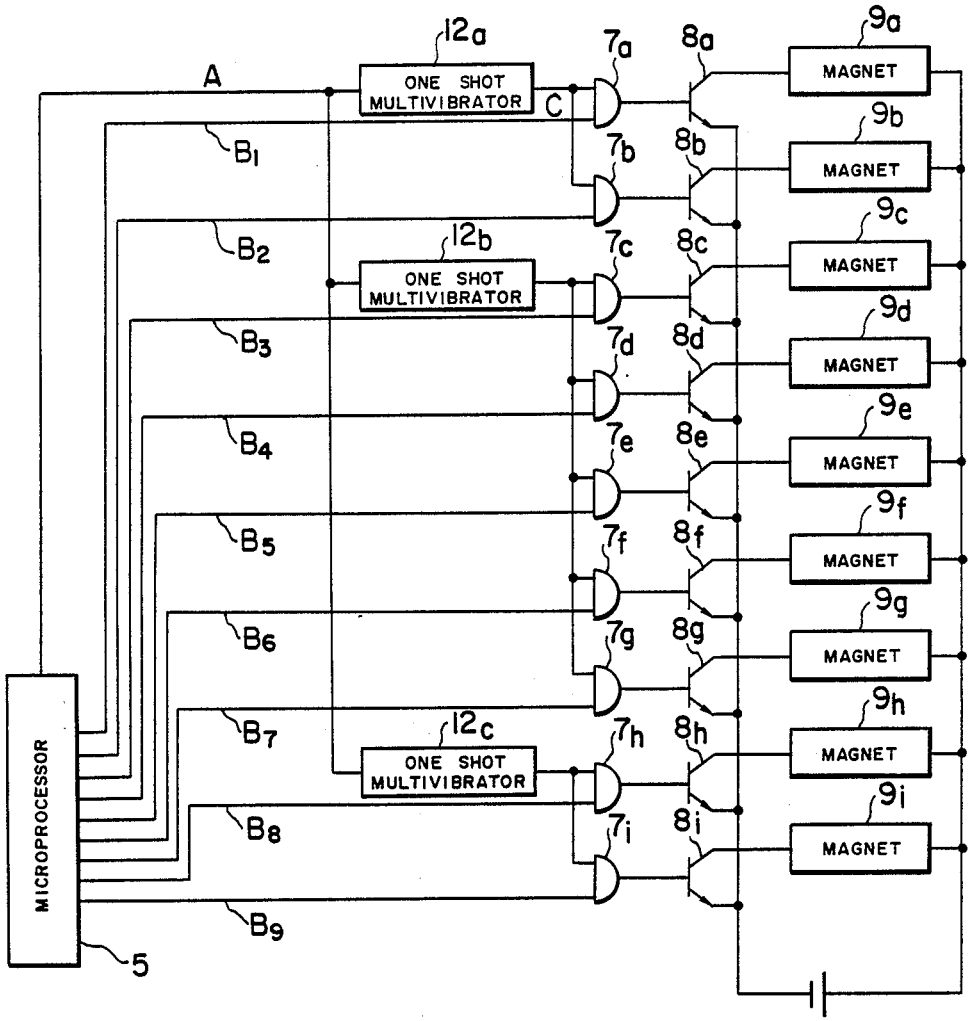
FIG. 4 is a circuit block diagram illustrating a second embodiment of the dot drive circuit of the present invention.

FIG. 4 is a circuit block diagram illustrating the second embodiment of the dot drive circuit of a wire dot type printer according to the present invention. Here, the dot drive circuit shown in FIG. 4 is appliable to the print head 1 of 9 pin dots shown in FIG. 2.

The dot drive circuit in the second embodiment is adapted to have three groups of dot pins, two on the upper end side, two on the lower end side, and five therebetween, and to further have dot drive time intervals $T'_1$, $T'_2$, and $T'_1$ for the respective groups in order.

Namely, the monostable multivibrator 12a is connected with input terminals of the gate circuits $7_a$, $7_b$ corresponding to the upper end side dot pin 3, the monostable multivibrator $12_C$ connected with input terminals of the gate circuits $7_h$, $7_i$ corresponding to the lower end side dot pin 3, and the monostable multivibrator $12_b$ is connected with input terminals of the gate circuits $7_c$, $7_d$, $7_e$, $7_f$, and $7_g$ corresponding to the other dot pins 3. By making use of these monostable multivibrators $12_a$, $12_b$, and $12_c$, the dot drive time interval $T'_1$ of the upper and lower end side dot pins 3 is made longer than the dot drive time intervals $T'_2$ of the dot pins 3 located therebetween for correcting uneven impact forces of the respective dot pins 3.

Moreover, although in the first and second embodiments, the case with a 9 pin head was described, the present invention is not limited thereto. Furthermore, the monostable multivibrators $10_a$ and $10_i$, $10_b$ and $10_h$, $10_c$ and $10_g$, $10_d$ and $10_f$, and $12_a$ and $12_e$ may respectively be single monostable multivibrators.

According to the dot drive circuit in the wire dot type printer of the present invention, as described above, dot drive time intervals of the respective dot pins are set for each dot pin or for each dot pin group in response to the sizes of gaps between the respective dot pins and the platen, uniform impact force of the dot pins can be assured even if the gaps are respectively different from each other as in a case of printing with use of a round-shaped platen, etc. Thus, uniform printing density can be assured while any printed character can be prevented from being stained owing to the dot pin being rebounded.

Although certain preferred embodiments have been shown and described, it should be understood that many changes and modifications may be made therein without departing from the scope of the appended claims.

What is claimed is:

1. A dot drive circuit for a wire dot printer adapted to permit respective dot pins of a print head to have different gaps to a platen, said dot drive circuit comprising:

a microprocessor for outputting a dot drive timing signal and a first selection signals;

means for setting different dot drive time intervals of said respective dot pins for each dot pin or for each group of dot pins in accordance with the sizes of said gap and for outputting drive pulses having different widths corresponding to the drive time intervals;

gate circuits for receiving said drive pulses;

magnets for printing corresponding to said selection signals and having a current to be conducted therethrough only during the time of the drive pulses being output as said microprocessor outputs said selection signals to said gate circuits.

2. A dot drive circuit of a wire dot pinter according to claim 1, wherein said means for setting a dot drive time interval comprises monostable multivibrators.

3. A dot drive circuit of a wire dot printer according to claim 1, wherein said dot drive time intervals are respectively a first prescribed time interval for upper and lower dot pins, and a second prescribed time interval for dot pins which located between said upper and lower pins.

4. A dot drive circuit of a wire dot printer according to claim 3, wherein there are two upper and lower dot pins and there are dot pins located between said upper and lower pins.

* * * * *